US005916724A

United States Patent [19]

Sekine et al.

[11] Patent Number: 5,916,724

[45] Date of Patent: Jun. 29, 1999

[54] METHOD FOR RECYCLING A SUBSTRATE FOR AN ORGANIC PHOTOSENSITIVE MEMBER

[75] Inventors: Ichirou Sekine, Sanda; Tetsushi Ikoma, Itami; Makoto Ban, Nishinomiya; Naoki Yoshie, Takatsuki, all of Japan

[73] Assignee: Minolta Co., Ltd., Osaka, Japan

[21] Appl. No.: 08/897,703

[22] Filed: Jul. 21, 1997

[30] Foreign Application Priority Data

Jul. 29, 1996 [JP] Japan ..... 8-198926

[51] Int. Cl.[6] ..... G03G 5/00

[52] U.S. Cl. ..... 430/133; 451/55; 134/2

[58] Field of Search ..... 134/2; 399/347; 430/133; 451/55

[56] References Cited

U.S. PATENT DOCUMENTS

| | | |
|---|---|---|
| 5,055,139 | 10/1991 | Personette . |
| 5,470,271 | 11/1995 | Briggs et al. . |
| 5,753,601 | 5/1998 | Ward et al. . |

FOREIGN PATENT DOCUMENTS

| | | |
|---|---|---|
| 61-209453 | 9/1986 | Japan . |
| 05257296 | 10/1993 | Japan . |
| 05281757 | 10/1993 | Japan . |
| 05341537 | 12/1993 | Japan . |

*Primary Examiner*—John Goodrow
*Attorney, Agent, or Firm*—McDermott, Will & Emery

[57] ABSTRACT

The object of the present invention is to provide a method for recycling a substrate for an organic photosensitive member, which is excellent in environmental properties, economical properties and safety. In order to achieve the above object, the present invention provides a method for recycling a substrate for an organic photosensitive member with a photosensitive layer that contains a binder resin on an electrically conductive substrate, comprising the steps of; steeping the photosensitive member in a separating liquid to swell the photosensitive layer, and rubbing a surface of the photosensitive member with a brush having a pile length of 5–50 mm, a pile diameter of 2.5–30 denier and a pile density of 100–20000 piles/cm$^2$.

26 Claims, 2 Drawing Sheets

METHOD FOR RECYCLING A SUBSTRATE FOR AN ORGANIC PHOTOSENSITIVE MEMBER

BACKGROUND OF THE INVENTION

1. Field of the Invention

The present invention relates to a method for recycling an electrically conductive substrate for an organic photosensitive member, more particularly to a method for recycling an electrically conductive substrate for an organic photosensitive member, characterized by swelling a photosensitive layer which contains a binder resin on the substrate, and separating the swelled photosensitive layer from the substrate.

2. Description of the Prior Art

A photosensitive member for electrophotography applied to electrophotographic machines, such as copying machines and printers, is conventionally an organic photosensitive member in which a resin-containing photosensitive layer is formed on an electrically conductive substrate. However, when such an organic photosensitive member is used for a long time, there arises a problem of wear and deterioration of the photosensitive layer, so that adverse effect to image property can't be avoided. Therefore, photosensitive members out of use or defective photosensitive members produced in manufacturing process, their products have been discarded including the substrate in the past, but from view points of worldwide resources-conservation and environmental protection a method for recycling the substrate has been studied.

In order to recycle a substrate for photosensitive member, a removing a photosensitive layer from the substrate is needed. As the method for removing the photosensitive layer from the substrate, for example, a method for removing the layer from the substrate by dissolving the layer in organic solvent (Japanese Patent Laid Open No. Hei 5-341537) and a method for removing the layer from the substrate by rubbing a surface of the photosensitive member with a brush while a solvent is sprayed on the surface (Japanese Patent Laid Open Nos. Sho 61-209453 and Hei 5-257296) are proposed. However all these techniques contains a step of dissolving the photosensitive layer in a solvent, so that the resin dissolved in the solvent adheres to the substrate again resulting in making it difficult to use the solvent repeatedly and lower the cost for recycling the substrate. Further, maybe a treatment of the solvent, in which the photosensitive layer is dissolved, will cause a new environmental problem. Furthermore, when the solvent to be used is highly flammable, there also arises a problem of safety.

SUMMARY OF THE INVENTION

The object of the present invention is to provide a method for recycling a substrate for an organic photosensitive member, being excellent in environmental properties, economical properties and safety.

In order to achieve the above object, the present invention provides a method for recycling an electrically conductive substrate for an organic photosensitive member with a photosensitive layer that contains a binder resin on the substrate, comprising the steps of;

steeping the photosensitive member in a liquid which can swell the binder resin to swell the photosensitive layer; and rubbing a surface of the photosensitive member with a brush having a pile length of 5–50 mm, a pile diameter of 2.5–30 denier and a pile density of 100–20000 piles/cm$^2$.

This and other objects, advantages and features of the invention will become apparent from the following description thereof taken in conjunction with the accompanying drawings which illustrates specific embodiment of the invention.

DETAILED DESCRIPTION OF THE INVENTION

Figure 1:
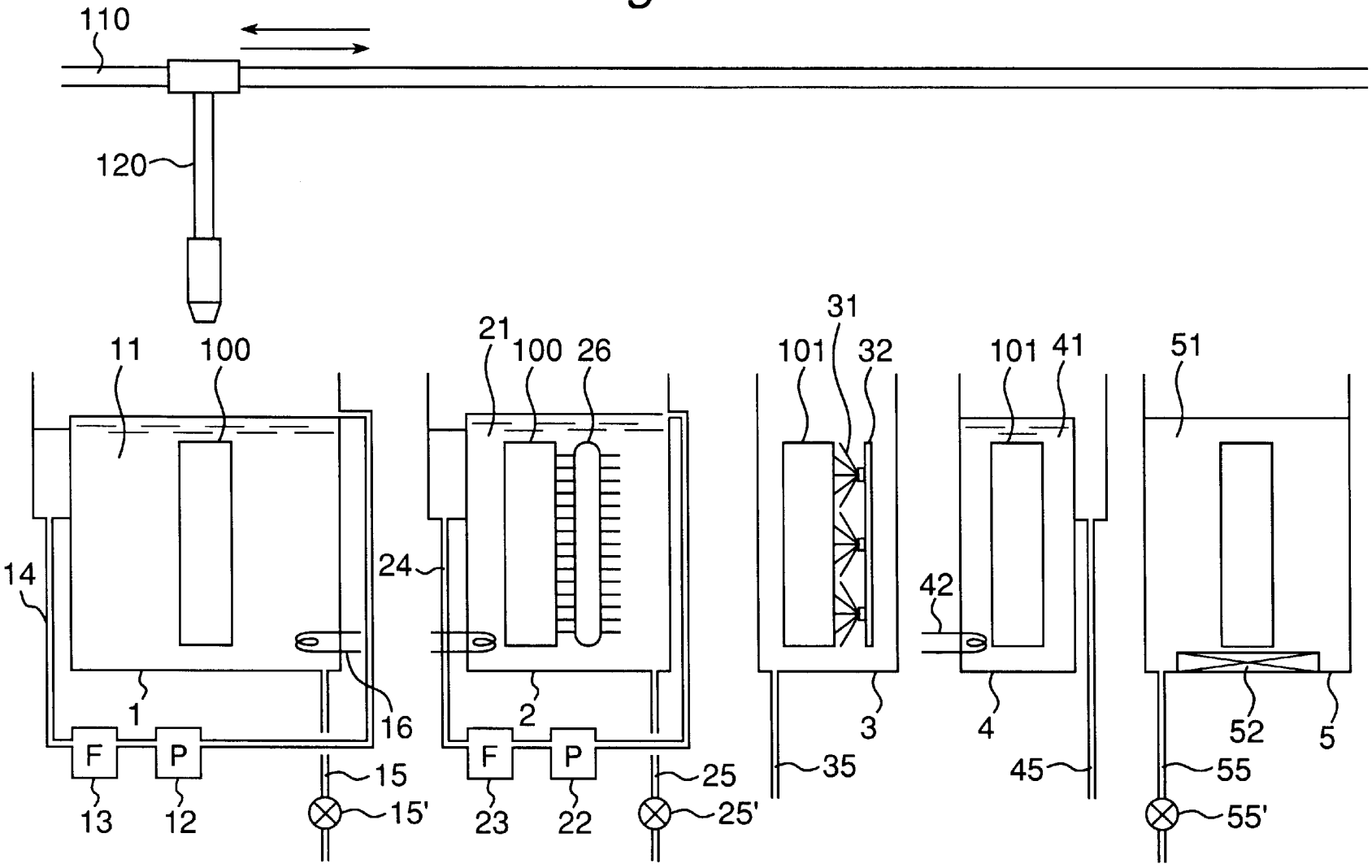
FIG. 1 is a schematic view of a process using a method of the present invention.

The present invention relates to a method for recycling a substrate for an organic photosensitive member, comprising the steps of; swelling a photosensitive layer by steeping the photosensitive member in a liquid which can swell the photosensitive layer ( called "separating liquid" hereinafter ) for a suitable time and rubbing a surface of the photosensitive member with a brush.

The separating liquid used in present invention may be a mixed solvent of an organic solvent, in which the binder resin can be dissolved, and water. In the present invention the photosensitive member is steeped in such a separating liquid for a suitable time to swell a photosensitive layer formed on an electrically conductive substrate and then a surface of the photosensitive member is rubbed with a brush, so that the substrate can be recycled remaining dimension and shape (roundness) of the substrate maintained without giving flaw to a surface of the substrate. Further, the layer will be able to be perfectly separated in filmy form from the substrate. The photosensitive member, in which the substrate recycled according to the present invention is used as a substrate, will have an equal static characteristics to a photosensitive member using a non-recycled new substrate.

In present invention, the photosensitive layer is not dissolved but swelled (finitely swelled) in such a liquid as above mentioned. Therefore, a conventional problem that the layer dissolved in solvent adheres to the substrate again can be solved, the solvent can be used repeatedly, and we can save a lot of labor etc. in treating a waste liquid. Accordingly, the method of the present invention is excellent in environmental properties and economical properties.

Further, the photosensitive member, whose photosensitive layer was swelled, is rubbed with a specific brush. Therefore, even when the layer is insufficiently separated by means of only steeping a photosensitive member in the separating liquid, use of the brush can bring about perfect and uniform separating of the layer on the substrate without giving flaw to the substrate.

The brush should be selected depending on dimension and construction of the photosensitive member and material of the brush. In general, when a pile diameter is too large, nerve of pile is too strong and the brush has a harmful effect on the surface of the substrate. When a pile diameter is too small, nerve of pile is too weak and an ability for removing the layer tends to drop. When pile is too long, pile is too pliable and piles are unlikely to uniformly contact with the substrate-surface. When pile is too short, a harmful effect of piles on the substrate-surface is too remarkable and piles are likely to give flaw to the substrate-surface. A pile density also depends on a pile diameter, but it is generally preferable that the density is high, because, when a pile density is too low, an area on substrate-surface where piles contact with and an area on substrate-surface where piles don't, are produced, so that uniform separating is unlikely to be achieved. However, when a pile density is too high, the photosensitive layer separated from the substrate enter between the brush and the substrate, so that there arises a problem that the brush can't be used for a long time. Accordingly, the brush used in the rubbing step of the present invention has a pile length of 5–50 mm, preferably 20–30 mm, a pile diameter of 2.5–30.0 denier, preferably 5–15 denier and a pile density of 100–20000 piles/$cm^2$, preferably 200–5000 piles/$cm^2$.

The pile of the brush is preferably made of nylon, rayon, Teflon, polyester or animal hair. Most preferably, from view points of a separating property, a durability and a cost merit the pile is made of nylon. When such a brush is applied while rotating at such a rate as the brush doesn't give flaw to substrate-surface, a separating property is much improved. Therefore, the brush is rotated at a rotary speed of 35–200 rpm, preferably 40–100 rpm. More effectively, the photosensitive member is also rotated at a rotary speed of 25–100 rpm.

The organic solvent, in which the binder resin can be dissolved, should be selected according to the binder resin to be used. Above all, the organic solvent is preferably a water-soluble solvent which can be uniformly mixed with water, because a layer-separation of the organic solvent from water doesn't bring about uniform separating. Examples of the organic solvent include a glycol ether solvent represented by the formula(I):

$$R_1O(C_mH_{2m}O)_nR_2 \quad (I)$$

(wherein $R_1$ is an alkyl group having not more than 4 carbon atoms or $CH_3CO$—, $R_2$ is a hydrogen atom, a methyl group or an ethyl group, m is 2 or 3, and n is an integer of 1–5), an amide solvent, a lactone solvent, such as γ-butyrolactone etc. In the present specification, the term of "a water-soluble organic solvent" means an organic solvent which is compatible with water in case of mixing the organic solvent with water at a volume ratio of 1:1 at 20° C.

Glycol ether solvent includes, but not limited to, alkylene glycol ether acetate, alkylene glycol dialkyl ether, alkylene glycol monoalkyl ether, more particularly, ethylene glycol monomethyl ether acetate, diethylene glycol monomethyl ether acetate, diethylene glycol monoethyl ether acetate, triethylene glycol monomethyl ether acetate, triethylene glycol monoethyl ether acetate, ethylene glycol diethyl ether, diethylene glycol dimethyl ether, diethylene glycol diethyl ether, triethylene glycol dimethyl ether, triethylene glycol diethyl ether, tetraethylene glycol dimethyl ether, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, propylene glycol monopropyl ether, ethylene glycol monoisopropyl ether, diethylene glycol monoisopropyl ether, triethylene glycol monobutyl ether, ethylene glycol monobutyl ether, diethylene glycol monobutyl ether, propylene glycol monomethyl ether, dipropylene glycol monomethyl ether, 3-methyl-3-methoxybutanol and so on.

Amide solvent includes, but not limited to, N-methylformamide, N,N-dimethylformamide, N,N-diethylformamide, N,N-dimethylacetamide, N-methylpropionamide, N,N,N',N'-tetramethylurea, N-methyl-2-pyrrolidone and so on.

In present invention, such a water-soluble organic solvent is diluted with water at a dilution ratio (the volume of water/the volume of the organic solvent) of 0.5–10, preferably 1–5, and the mixture of the organic solvent with water is used as the separating liquid. In the present specification, "a dilution ratio" means a ratio of the volume of water to the volume of the organic solvent, for example, when the organic solvent and water are mixed at a mixing volume ratio of 2:3 to make a separating liquid, the separating liquid has a dilution ratio of 1.5. When the dilution ratio is less than 0.5, the resin contained in a photosensitive layer is dissolved in the separating liquid and the effect of the present invention is unlikely to be achieved. When the dilution ratio is more than 10, an ability to swell the photosensitive layer is weakened. In this way, a binder resin-solvency of the organic solvent is controlled by mixing water with the solvent, so that the binder resin is prevented from dissolving in the separating liquid and the photosensitive layer can be separated in filmy form. Further, when the organic solvent is needed to be handled in an explosion-proof system because of having a high flammability in the case of being used alone, an addition of water to the solvent makes it easy to treat the mixture i.e. the separating liquid and improve a safety.

The photosensitive member to which the method for recycling the substrate according to the present invention can be applied, may be any organic photosensitive member conventionally known in this field. Among those, the photosensitive member with a photosensitive layer containing polycarbonate resin is more effective in the present invention. The present invention enables to separate the photosensitive layer whose thickness is up to about 100 μm, preferably about 50 μm. For a substrate of the above photosensitive member, a substrate may be made of aluminum or aluminum alloy etc., and its surface may be anodized.

A process for recycling the substrate for the organic photosensitive member by separating a photosensitive layer on a substrate according to the present invention is explained in following. In the process, a photosensitive member with a photosensitive layer is first steeped in the separating liquid at a liquid temperature of 10–80° C., preferably 20–60 C. for 5–180 minutes, preferably 30–90 minutes to swell the layer, and then the surface of the layer is physically rubbed to be separated in filmy form. For example, when the present invention is applied to a lamination-type of photosensitive member, in which a charge generating layer and a charge transporting layer are formed on a electrically conductive substrate, the upper layer or the charge transporting layer is likely to be swelled so that the layer is naturally separated in the steeping step in many cases. To the contrary, although the lower layer or the charge generating layer is unlikely to be swelled in, a rubbing process of the substrate-surface with a brush in the following step enables to separate perfectly the charge generating layer on the substrate. Even when the charge transporting layer is insufficiently separated by only steeping the photosensitive member in the separating liquid, the remaining charge transporting layer and the charge generating layer can be perfectly separated in the following rubbing step. In the case where a photosensitive member is formed of a monolayer-type of a photosensitive layer, although the photosensitive layer is unlikely to be swelled, the photosensitive layer can be perfectly separated by steeping the photosensitive member in the separating liquid to be swelled the layer, followed by rubbing physically the surface of the photosensitive member with the brush.

In the steeping and the rubbing steps an air-bubbling and a water-jet bubbling etc. may be used in order to promote the separating of the layer. In particular, an ultrasonic wave with a vibration number of 10–50 KHz is preferably applied to promote the separating in the steeping step.

In such a condition as above mentioned, the photosensitive layer is separated in filmy form, so that the dissolving of the layer in the separating liquid, which occurred in the past, is reduced and the separating liquid can repeatedly be used. Furthermore, the filmy separated layer in the separating liquid can easily be removed by means of a filter, a strainer and a filter paper while the liquid is circulated. Accordingly, the separating liquid can be used for a much long time.

The substrate for the photosensitive member, which was given by separating the photosensitive layer from the substrate in this way, is supplied to a step for rinsing the separating liquid. When the substrate is needed to be stored for a long period, the rinsed substrate is further supplied to an anti-corrosive step. However, when water is adhered to the surface of the substrate to be supplied to the anti-corrosive step, perfect anti-corrosive treatment of the substrate can't be carried out in many cases. Therefore, the rinsed substrate is preferably subjected to a drying step prior to the anti-corrosive step in order to achieve perfect removal of water from the substrate-surface. On the other hand, when a new photosensitive layer is formed on the substrate immediately after separating the old photosensitive layer, the layer-separated substrate may be rinsed and then subjected to a step for washing the substrate in a conventional manufacturing line for a photosensitive member, or may be subjected to the substrate-washing step in the line without being rinsed. Furthermore, the rinsed substrate may be dried and then be directly provided for a step for forming the photosensitive layer in the line.

With regard to a method for rinsing the substrate in the rinsing step, any of those methods in which the separating liquid on the substrate-surface can be rinsed away may be used in the present invention, and method enumerated below by way of examples as such may be used; a method for rinsing the liquid for 5–120 seconds at a water rate of 0.2–10 liter/min. with a shower of tap water of a water pressure 1–50 kg/cm$^2$; a means for rinsing the liquid by steeping the substrate in a vessel with tap water overflowing while applying a brush, an ultrasonic wave and a bubbling and so on to the substrate-surface in the vessel.

The rinsed substrate is, in case of being stored for a long period, further provided for an anti-corrosive step as above. To be more detailed, the rinsed substrate is steeped for 5–120 seconds in the steeping tank in which a commercially available anti-corrosive agent, such as coal oil and liner, branched, alicyclic or aromatic hydrocarbon oil, for example alkyl, cycloalkyl, allyl hydrocarbon oil, is held. In this step, an ultrasonic wave of 40–100 KHz is preferably applied to the substrate-surface in order to remove the residual water remained on the surface in the preceding step, i.e. above rinsing step. Such an anti-corrosively treated substrate can be usually stored for 6–12 months. When a photosensitive layer is formed on the anti-corrosively treated substrate, the anti-corrosive agent on the substrate-surface can be washed out in a substrate-washing step of a conventional manufacturing line for photosensitive member and then a new photosensitive layer can be directly formed on the washed substrate at once in the line.

In the case where the rinsed substrate is subjected to a drying step prior to the anti-corrosive step, the drying treatment is carried out for the purpose of drying up water adhered to the substrate-surface in the rinsing step. The method for drying water is not particularly limited as long as water on the substrate-surface can perfectly evaporate without having bad influence on the surface, and the methods enumerated below by way of examples as such may be used; a hot pure water-drying method in which the substrate is steeped in a vessel which holds the pure water having a temperature of 30–80° C. and the steeped substrate is pulled up at a rate of 5–50 mm/sec.; a solvent-drying method in which the substrate is dipped in a hydro-extracting solvent and naturally dried, and; a hot air-drying method in which a cleaned air having a temperature of 40–90° C. is blown on the substrate for 15–18 seconds at a rate of 1–5 m/sec. Preferably, the hot pure water-drying method is used. In this case, it is more preferable that the air in system is evacuated at a rate of 0.5–2.0 m/sec. in order to prevent the water vapor from adhering to the substrate again, and/or that the vessel is overflowing with water at a rate of 1–20 liter/ min. so that the water in the vessel can maintain an electric conductivity of 10 $\mu$s/cm or less in order to avoid deterioration of the water quality.

The substrate recycled in above method is provided again to produce a photosensitive member in the same way as in production of a conventional photosensitive member whose substrate is not a recycled substrate. The recycled substrate is washed and then layers, such as a base layer, a photosensitive layer and a protective layer, may be formed thereon.

A method for washing the recycled substrate prior to forming the layers thereon may be same as in a substrate-washing step in a manufacturing process for a conventional photosensitive member. For example, a substrate is brought to some washing tanks in order and the substrate is washed by being steeped in their respective wash liquid held in their tanks, or by spraying their respective wash liquid on the substrate in their washing tank. For the wash liquid, any of those which have conventionally been used in this art may be equally used in present invention. From view points of an environmental properties, the wash liquid is preferably water-soluble in many cases. Examples of such a wash liquid are exemplified; tap water, pure water, deionized water, their mixture with the surfactant, hydrocarbon solvent or higher alcohol, or wash liquid for chemical etching.

As the substrate comes to final stage in the washing step, water having a higher degree of purity is preferably used. An electric conductivity of water is more preferably 5 $\mu$s/cm or less, most preferably 1 $\mu$s/cm or less. A temperature of the wash liquid is 15–65° C, preferably 30–50° C. In this step, the washing treatment may be carried out in a physical method, such as by bringing a brush, a sponge or a rubber into contact with the substrate-surface in the wash liquid, by jet-spray washing in which the wash liquid, which is spouted at high pressure, is applied to the substrate-surface, and by ultrasonic wave washing.

The substrate, which was washed in manufacturing process for a photosensitive member, is subjected to a drying step, if desired. For a method for drying the washed substrate, any of those methods which have conventionally been used in manufacturing process for a photosensitive member may be used in this step. Further, the methods for drying the substrate in the recycling process of the substrate as described above may be used in this step.

For a method for forming above layers on the substrate, the coating methods are generally used and such methods can be exemplified by a dipping method, a spray coating method, a spinner coating method, a blade coating method, a roller coating method, a mire-bar coating method.

When the substrate recycled in this way is provided for a conventional process for forming a photosensitive layer thereon as described above, a photosensitive member which can be applied to a copying machine for electrophotography can be newly provided. This photosensitive member, i.e. the recycled photosensitive member, can provide an image which is as excellent as one provided by a conventionally new photosensitive member, i.e. non-recycled photosensitive member using a new substrate.

The present invention will be further illustrated with reference to specific examples given hereinbelow.

EXAMPLE 1

FIG. 1 is a schematic view of a process using the method for recycling a substrate for an organic photosensitive member according to the present invention. This apparatus is constituted of a steeping tank 1, a brushing tank 2, a rinsing tank 3, a hydro-extracting tank 4 and an anti-corrosively treating tank 5. The steeping tank 1 holds a separating liquid 11 having a temperature of 60° C., in which diethylene glycol monoethyl ether acetate is diluted with water at a dilution ratio (the volume of water/the volume of diethylene glycol monoethyl ether acetate) of 5. The temperature of the separating liquid is controlled by a heater 16. A used photosensitive member 100 for a commercially available copying machine (EP-470Z, made by Minolta K. K.) was steeped in the separating liquid 11 for 60 minutes to swell the photosensitive layer and then transferred to the brushing tank 2. Transference of the photosensitive member 100 and the substrate 101 from the steeping tank 1 to the brushing tank 2 and from one tank to another tank is carried out by an industrial robot-hand 120 installed on a runway 110. The photosensitive member 100 used in this example is of laminated type, in which the charge generating layer containing bisazo pigment and poly (vinyl butyral) resin, and the charge transporting layer containing hydrazone derivative and polycarbonate resin are formed on the aluminum substrate 101 in order.

The brushing tank 2 holds the separating liquid 21 having the same composition as in the steeping tank 1. The photosensitive member 100 steeped in the steeping tank 1 was steeped in this liquid 21 and its surface was rubbed with the cylindrical brush 26 for 30 seconds to separate the photosensitive layer from the substrate, while the brush is arranged to the direction of the axis for the photosensitive member 100 and is rotating at a rate of 50 rpm. The brush has a pile length of 30 mm, a pile diameter of 8 denier and a pile density of 200 piles/cm$^2$ and is made of nylon. In this example, it was demonstrated that the photosensitive layer could be separated in filmy form without being dissolved in the separating liquid within the brushing tank 2. The separating liquid 11 and 21 overflowed from the steeping tank 1 and the brushing tank 2 are respectively circulated via a pipes 14 and 24 through filters 13 and 23 by pumps 12 and 22. The filter catches suspended matters and impurities, such as the separated filmy photosensitive layer etc., so that the separating liquid can be kept clean for a long period. The tank 1 and 2 respectively have a discharging drain pipe 15 or 25, and discharge valve 15' or 25' at bottom, thereby exchange of the liquid in tank 1 and 2 is carried out.

The substrate of the photosensitive member, with the photosensitive layer separated in this way, is transferred to the rinsing tank 3. In the rinsing tank 3, the substrate was rinsed for 60 seconds with a shower of tap water 31 having a water pressure of 10 kg/cm$^2$ at a water rate of 5 liter/min. from a nozzle 32 which is installed along the sidewall within the tank 3. The applied liquid is discharged from the discharging drain pipe 35. The rinsed substrate 101 was then transferred to the hydro-extracting tank 4. The hydro-extracting tank 4 holds pure water 41 and the temperature of the water is controlled to 70° C. by a heater 42. The substrate 101 was steeped therein and pulled up at an rate of 30 mm/sec. to carry out hot pure water-drying.

In this time, the air in system was being evacuated at an air-speed of 1 m/sec., the pure water was overflowing at a rate of 10 liter/min., and the overflowed water was being discharged from a discharging drain pipe 45. The water in the tank 4 maintained an electric conductivity of 1 $\mu$s/cm. The dried substrate 101 was transferred to the anti-corrosively treating tank 5. The anti-corrosively treating tank 5 holds coal oil as an anti-corrosive agent 51. The substrate 101 was steeped in the coal oil for 20 seconds with ultrasonic wave 52 of 40 KHz applied to the substrate, and then pulled up. The anti-corrosively treating tank 5 has a discharging drain pipe 55, so that the residual water at bottom in the treating tank 5 and the other impurity can be discharged therefrom. The anti-corrosively treated substrate 101 was stored for 3 months in a corrugated box.

Figure 2:
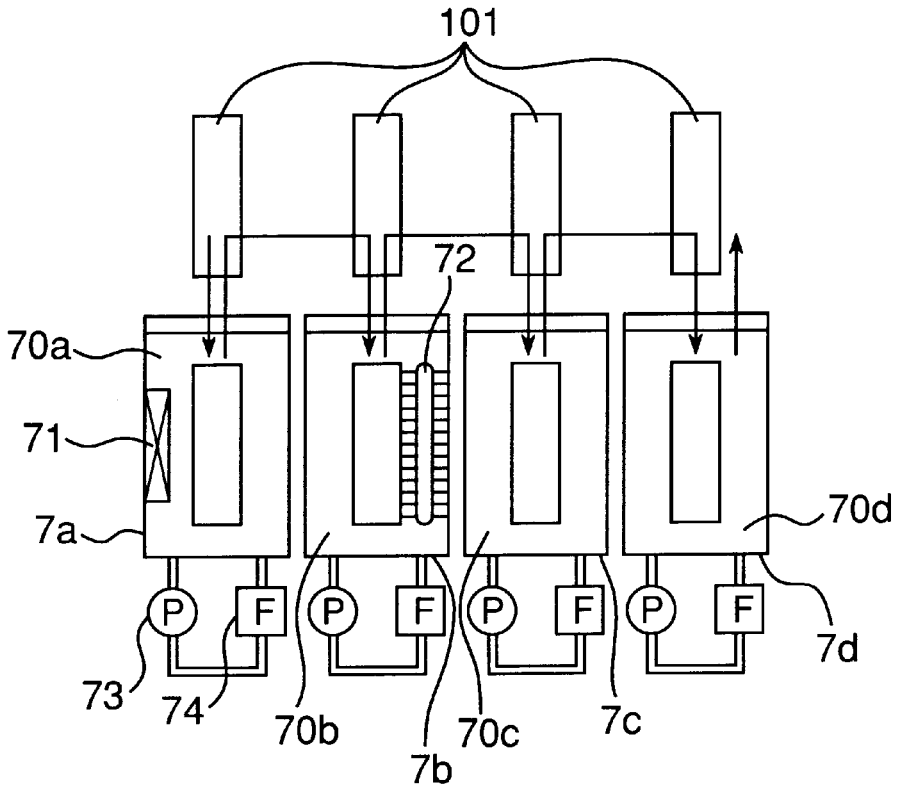
FIG. 2 is a schematic view of a washing step.

After the substrate was stored for 3 months, the substrate was washed as shown in FIG. 2. The substrate 101 was steeped in a washing tank **7*a* which was filled with an aqueous wash liquid 70*a* containing 5 vol % of surfactant (CW-5520; made by Daiichi Kogyou Seiyaku K. K.) and having a temperature of 40° C., and ultrasonic wave of 40 KHz, which was generated from an ultrasonic oscillator 71 installed in the washing tank, was applied to the steeping substrate for 1 minute to wash out the anti-corrosive agent on its surface. The washed substrate 101 was then transferred to a pure-water tank 7*b* filled with pure water 70*b* and rubbed with a brush 72 in the pure water for washing. The washed substrate 101 was then transferred to a rinsing tank 7*c* filled with pure water 70*c* having an electric conductivity of 5 $\mu$s/cm or less and rinsed in the tank 7*c* for washing. The sufficiently washed substrate 101 was transferred to a hot pure water tank 7*d* filled with hot pure water 70*d* having a temperature of 70° C., steeped therein and then pulled up to be dried. The liquid 70*a*–70*d* held in heir tanks 7*a*–7*d* were being respectively circulated through a filter 74 by a pump 73** so that their liquid could be purified.

On the recycled substrate 101, the charge generating layer and the charge transporting layer were formed in order to give a photosensitive member for a commercially available copying machine (EP-470; made by Minolta K. K.) again. The first time of recycling procedure for producing a photosensitive member, in which the substrate recycled according to the present invention was used, was finished in this way.

Above recycling procedure was further repeated two times using the same separating liquid under the same conditions as in the first procedure. The photosensitive members, which were produced in the first time and the third time of procedures, were respectively installed in a copying machine (EP-470Z; made by Minolta K. K.). A copy process was repeated 60,000 times. The copied images formed by one- and three-recycled photosensitive members were compared with the copied image formed by a non-recycled photosensitive member with respect to image noises. Further, the one- and three-recycled photosensitive members were compared with the non-recycled photosensitive member for the copying machine (EP-470Z; made by Minolta K. K.) in reference to an initial electrostatic property. Furthermore, the recycled substrates given in the first time and third time of recycling procedures were compared with a new substrate in reference to a flaw on the substrate-surface, an external diameter and a roundness just before the photosensitive layers were formed thereon. Their evaluations were made as follows.

"◎": Properties of the recycled substrate or photosensitive member were as good as those of the non-recycled substrate or photosensitive member.

"○": Properties of the recycled substrate or photosensitive member were slightly poorer than those of the non-recycled substrate or photosensitive member but practically no problem.

"x": Properties of the recycled substrate or photosensitive member were much poorer than those of the non-recycled substrate or photosensitive member and considered to be a problem from practical view points.

(Noises in copied images)

The original copied images (half tone image) provided by using above one-, three- and non-recycled photosensitive members were visually evaluated as to noises in copied images (black line, black spot), to be ranked as "◎", "603 " or "x" as above mentioned.

(Initial electrostatic property)

Figure 3:
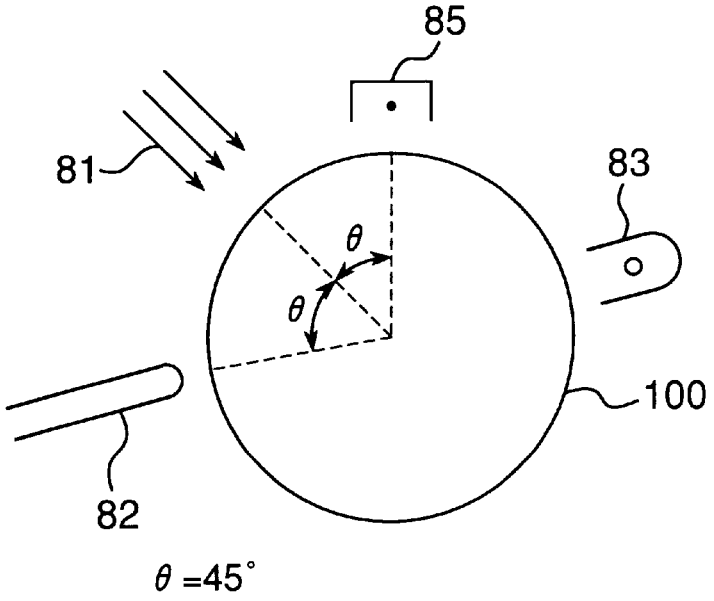
FIG. 3 is a schematic view of a tester for measuring static characteristics of the photosensitive member.

An initial electrostatic properties of above one-, three- and non-recycled photosensitive members 100 were measured by a photosensitive member tester shown in FIG. 3 as follows. A photosensitive member rotating at a peripheral speed of 110 mm/sec. was corona-charged by application of −6 kV voltage from a charger 85 and the surface potential $V_0$ (V) of the photosensitive member was measured by a potential probe 82. Further, an exposure amount (an exposure amount for reducing to half the surface potential) E½ (lux·sec.) which was required so that the surface potential $V_0$ can be reduced to half the potential, a reduction rate $DDR_5$ (%) of a surface potential reduced in 5 seconds in the dark to the initial surface potential, and a residual potential $V_R$ (V) on the surface after erasing (50 lux·sec.) with an eraser 83 were measured. These results were ranked as "◎", "○" or "x" as above mentioned.

(Durability test)

After 60,000 times of copy were repeated at room temperature using above one-, three- and non-recycled photosensitive members, their half-tone copied images were visually evaluated as to noises in copied images (black line, black spot), to be ranked as "◎", "○" or "x" as above mentioned.

(Flaw by the Brush)

The substrates for the photosensitive member, which were given in above first- and third-recycling procedure, and the new substrate were visually evaluated as to the flaw by the brush on the surface, to be ranked as "◎", "○" or "x" as above mentioned. When the evaluation of the substrate given in the first-recycling procedure was "x", the following recycling procedure was not carried out.

(Dimensional Accuracy of the Substrate)

The substrates of the photosensitive member, which were given in above first- and third-recycling procedure, and the new substrate were measured as to an external diameter and a roundness, to be ranked as "◎", "○" or "x" as above mentioned.

(Adhesion of the Photosensitive Layer)

Above one-, three- and non-recycled photosensitive members were left at −30° C. for an hour and then at 70° C. for an hour. This procedure was repeated four times. The surface of the photosensitive members was cut in area of 1 centimeters square with a knife every 1 mm space as a mesh and thereon an adhesive tape having a width of 24 mm was put and tore away quickly. Adhesion of the photosensitive layer was evaluated by observing the photosensitive layer leaves adhering to the tape, to be ranked as "◎", "○" or "x" as above mentioned.

These results were summarized in table 1, as well as above performing condition.

EXAMPLES 2–6 AND COMPARATIVE EXAMPLES 1–3

In Examples 2–4 and Comparative Examples 1–3, procedure for recycling the substrate for the photosensitive member was repeated in a manner similar to Example 1, except for using the performing conditions shown in table 1 and 2. In Examples 5 and 6, procedure for recycling the substrate for the photosensitive member was repeated in a manner similar to Example 1, except for using an aluminum substrate with an anodized layer on the surface thereof instead of an aluminum substrate and using the performing conditions shown in table 1. The photosensitive members and substrates, which were produced in the first time and the third time of procedures, were evaluated in a manner similar to Example 1. These results were shown in table 1 and 2.

TABLE 1

| Step | Heading | | Ex. 1 | Ex. 2 | Ex. 3 | Ex. 4 | Ex. 5 | Ex. 6 |
|---|---|---|---|---|---|---|---|---|
| steeping | separating liquid | dilution ratio | 5 | 10 | 5 | 5 | 5 | 5 |
| | | temperature (°C.) | 60 | 60 | 60 | 60 | 60 | 60 |
| | steeping time (min.) | | 60 | 90 | 60 | 60 | 60 | 60 |
| rubbing | material | | nylon | nylon | nylon | nylon | nylon | nylon |
| brush | pile diameter (denier) | | 8 | 8 | 10 | 30 | 10 | 30 |
| conditions | pile length (mm) | | 30 | 30 | 20 | 10 | 20 | 10 |
| | density (piles/cm$^2$) | | 200 | 200 | 5000 | 900 | 5000 | 900 |
| rinsing | water pressure (kg/cm$^2$) | | 10 | 10 | 10 | 10 | 10 | 10 |
| | amount of water (L/min.) | | 5 | 5 | 5 | 5 | 5 | 5 |
| | time (sec.) | | 60 | 60 | 60 | 60 | 60 | 60 |
| drying | temperature of water (°C.) | | 70 | 70 | 70 | 70 | 70 | 70 |
| | pulling up rate (mm/sec.) | | 30 | 30 | 30 | 30 | 30 | 30 |
| | evacuating rate (m/sec.) | | 1 | 1 | 1 | 1 | 1 | 1 |
| | amount of water (L/min.) | | 10 | 10 | 10 | 10 | 10 | 10 |
| | water quality (μs/cm) | | 1 | 1 | 1 | 1 | 1 | 1 |
| anti-corro- | anti-corrosive liquid | | coal oil | coal oil | coal oil | coal oil | — | — |
| sively | time (sec.) | | 20 | 20 | 20 | 20 | — | — |

TABLE 1-continued

| Step | Heading | Ex. 1 | | Ex. 2 | | Ex. 3 | | Ex. 4 | | Ex. 5 | | Ex. 6 | |
|---|---|---|---|---|---|---|---|---|---|---|---|---|---|
| treating | ultrasonic wave (KHz) | 40 | | 40 | | 40 | | 40 | | — | | — | |
| evaluation | recycling time(s) | 1 | 3 | 1 | 3 | 1 | 3 | 1 | 3 | 1 | 3 | 1 | 3 |
| | noises in copied images | ◎ | ○ | ◎ | ○ | ◎ | ◎ | ◎ | ○ | ◎ | ◎ | ◎ | ○ |
| | initial electrostatic property | ◎ | ◎ | ◎ | ◎ | ◎ | ◎ | ◎ | ◎ | ◎ | ◎ | ◎ | ◎ |
| | durability test | ◎ | ○ | ◎ | ○ | ◎ | ◎ | ◎ | ○ | ◎ | ◎ | ◎ | ○ |
| | dimensional and shapely accuracy | ◎ | ◎ | ◎ | ◎ | ◎ | ◎ | ◎ | ◎ | ◎ | ◎ | ◎ | ◎ |
| | adhesion of the layer | ◎ | ◎ | ◎ | ◎ | ◎ | ◎ | ◎ | ◎ | ◎ | ◎ | ◎ | ◎ |
| | flaw by the brush | ◎ | ◎ | ◎ | ◎ | ◎ | ◎ | ◎ | ◎ | ◎ | ◎ | ◎ | ◎ |

TABLE 2

| Step | Heading | | Co. Ex. 1 | | Co. Ex. 2 | | Co. Ex. 3 | |
|---|---|---|---|---|---|---|---|---|
| steeping | separating liquid | dilution ratio | 5 | | 5 | | 5 | |
| | | temperature (°C.) | 60 | | 60 | | 60 | |
| | steeping time (min.) | | 60 | | 60 | | 60 | |
| rubbing brush conditions | material | | nylon | | nylon | | nylon | |
| | pile diameter (denier) | | 50 | | 10 | | 50 | |
| | pile length (mm) | | 30 | | 60 | | 20 | |
| | density (piles/cm$^2$) | | 300 | | 5000 | | 100 | |
| rinsing | water pressure(kg/cm$^2$) | | 10 | | 10 | | 10 | |
| | amount of water (L/min.) | | 5 | | 5 | | 5 | |
| | time (sec.) | | 60 | | 60 | | 60 | |
| drying | temperature of water (°C.) | | 70 | | 70 | | 70 | |
| | pulling up rate (mm/sec.) | | 30 | | 30 | | 30 | |
| | evacuating rate (m/sec.) | | 1 | | 1 | | 1 | |
| | amount of water (L/min.) | | 10 | | 10 | | 10 | |
| | water quality (μs/cm) | | 1 | | 1 | | 1 | |
| anti-corrosively treating | anti-corrosive liquid | | coal oil | | coal oil | | coal oil | |
| | time (sec.) | | 20 | | 20 | | 20 | |
| | ultrasonic wave (KHz) | | 40 | | 40 | | 40 | |
| evaluation | recycling time(s) | 1 | 3 | 1 | 3 | 1 | 3 | |
| | noises in copied images | x | — | x | x | x | — | |
| | initial electrostatic property | ◎ | — | ○ | ○ | ◎ | — | |
| | durability test | x | — | x | x | x | — | |
| | dimensional and shapely accuracy | ○ | — | ◎ | ◎ | ○ | — | |
| | adhesion of the layer | ○ | — | ○ | x | ○ | — | |
| | flaw by the brush | x | — | ◎ | ◎ | x | — | |

"—": no evaluation was made.

The present invention is able to provide a method for recycling a substrate for an organic photosensitive member, being excellent in environmental properties, economical properties, safety, and dimensional and shapely accuracy without giving flaws to the substrate.

Although the present invention has been fully described by way of examples as well as the accompanying drawings, it is to be noted that various changes and modification will be apparent to those skilled in the art.

What is claimed is:

1. A method for recycling an electrically conductive substrate for an organic photosensitive member with a photosensitive layer that contains a binder resin on the substrate, comprising the steps of;

steeping the photosensitive member in a liquid which can swell the binder resin to swell the photosensitive layer; and rubbing a surface of the photosensitive member with a brush having a pile length of 5–50 mm, a pile diameter of 2.5–30 denier and a pile density of 100–20000 piles/cm$^2$.

2. A method of claim 1, in which the swelled photosensitive layer is separated in filmy form.

3. A method of claim 1, in which the liquid is a mixed solvent comprising a water-soluble organic solvent which can dissolve the binder resin, and water.

4. A method of claim 3, in which the mixed solvent has a volume ratio of water to the organic solvent of 0.5–10.

5. A method of claim 3, in which the water-soluble organic solvent is selected from the group consisting of alkylene glycol alkyl ether, alkylene glycol acetate, amide and lactone.

6. A method of claim 3, in which the water-soluble organic solvent is an organic solvent represented by the formula(I):

$$R_1O(C_mH_{2m}O)_nR_2 \quad (I)$$

(wherein $R_1$ is an alkyl group having not more than 4 carbon atoms or $CH_3CO$—, $R_2$ is a hydrogen atom, a methyl group or an ethyl group, m is 2 or 3, and n is an integer of 1–5).

7. A method of claim 1, in which the brush has a pile length of 20–30 mm.

8. A method of claim 1, in which the brush has a pile diameter of 5–15 denier.

9. A method of claim 1, in which the brush has a pile density of 200–5000 piles/cm$^2$.

10. A method of claim 1, in which the substrate is an aluminum substrate or an aluminum substrate with an anodized layer on the surface thereof.

11. A method of claim 1, further comprising the steps of;

washing the rubbed substrate; and forming a photosensitive layer on the washed substrate.

12. A method of claim 1, further comprising the step of;

anti-corrosively treating the rubbed substrate by applying the substrate with a coal oil.

13. A method of claim 2, further comprising the step of removing the separated photosensitive layer.

14. A method for recycling an electrically conductive substrate for an organic photosensitive member with a charge transporting layer that contains a charge transporting material and a binder resin laminated on a charge generating layer on the substrate, comprising the steps of;

steeping the photosensitive member in a liquid which can swell the binder resin to swell the charge transporting layer; and rubbing a surface of the photosensitive member with a brush having a pile length of 5–50 mm, a pile diameter of 2.5–30 denier and a pile density of 100–20000 piles/cm$^2$.

15. A method of claim 14, in which the swelled charge transporting layer is separated in filmy form.

16. A method of claim 14, in which the liquid is a mixed solvent comprising a water-soluble organic solvent which can dissolve the binder resin, and water.

17. A method of claim 16, in which the mixed solvent has a volume ratio of water to the organic solvent of 0.5–10.

18. A method of claim 16, in which the water-soluble organic solvent is selected from the group consisting of alkylene glycol alkyl ether, alkylene glycol acetate, amide and lactone.

19. A method of claim 16, in which the water-soluble organic solvent is an organic solvent represented by the formula(I):

$$R_1O(C_mH_{2m}O)_nR_2 \quad (I)$$

(wherein $R_1$ is an alkyl group having not more than 4 carbon atoms or $CH_3CO$—, $R_2$ is a hydrogen atom, a methyl group or an ethyl group, m is 2 or 3, and n is an integer of 1–5).

20. A method of claim 14, in which the brush has a pile length of 20–30 mm.

21. A method of claim 14, in which the brush has a pile diameter of 5–15 denier.

22. A method of claim 14, in which the brush has a pile density of 200–5000 piles/$cm^2$.

23. A method of claim 14, in which the substrate is an aluminum substrate or an aluminum substrate with an anodized layer on the surface thereof.

24. A method of claim 14, further comprising the steps of;

washing the rubbed substrate; and forming a charge generating layer and a charge transporting layer on the washed substrate.

25. A method of claim 14, further comprising the step of;

anti-corrosively treating the rubbed substrate by applying the substrate with a coal oil.

26. A method of claim 15, further comprising the step of removing the separated charge transporting layer.

* * * * *